US009490559B2

(12) United States Patent
Takane

(10) Patent No.: US 9,490,559 B2
(45) Date of Patent: Nov. 8, 2016

(54) CONNECTOR HAVING EASILY UNFASTENED LOCK LEVER FROM A FLAT CONDUCTOR

(71) Applicant: IRISO ELECTRONICS CO., LTD., Kanagawa (JP)

(72) Inventor: Toru Takane, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 14/933,727

(22) Filed: Nov. 5, 2015

(65) Prior Publication Data

US 2016/0134043 A1 May 12, 2016

(30) Foreign Application Priority Data

Nov. 12, 2014 (JP) ..... 2014-229859

(51) Int. Cl.

| | |
|---|---|
| ***H01R 13/15*** | (2006.01) |
| ***H01R 13/62*** | (2006.01) |
| ***H01R 12/77*** | (2011.01) |
| *H01R 12/79* | (2011.01) |

(52) U.S. Cl.

CPC ..... *H01R 12/774* (2013.01); *H01R 12/79* (2013.01)

(58) Field of Classification Search

CPC ..... H01R 12/771; H01R 9/2491; H01R 13/5221; H01R 13/6273; H01R 13/6275; H01R 12/79

USPC ..... 439/626, 350, 260, 495, 345

See application file for complete search history.

(56) References Cited

U.S. PATENT DOCUMENTS 8,317,533 B2 * 11/2012 Ishimaru ..... H01R 12/79 439/345
8,851,918 B2 * 10/2014 Yoshisuji ..... H01R 13/639 439/260
9,263,812 B2 * 2/2016 Ishimaru ..... H01R 12/774
2012/0064749 A1 * 3/2012 Hashimoto ..... H01R 12/774 439/329
2015/0270632 A1 * 9/2015 Takane ..... H01R 12/716 439/78
2016/0126649 A1 * 5/2016 Takane ..... H01R 13/42 439/660

FOREIGN PATENT DOCUMENTS

| | | |
|---|---|---|
| JP | 09-106867 A | 4/1997 |
| JP | 2012-059535 A | 3/2012 |
| JP | 2012-199187 A | 10/2012 |

OTHER PUBLICATIONS

Office Action from Japanese Patent App. No. 2014-229859 (Dec. 19, 2014) with English translation thereof.

* cited by examiner

*Primary Examiner* — Hae Moon Hyeon

(74) *Attorney, Agent, or Firm* — Cermak Nakajima & McGowan LLP; Tomoko Nakajima

(57) ABSTRACT

A connector includes a lock lever that is fastened to a flat conductor and that maintains electrical connection between a terminal and the flat conductor. The lock lever includes a fastening portion that, in an interior of a fitting chamber, is fastened to the flat conductor that electrically contacts the terminal, and prevents removal of the flat conductor; an elastic portion that displaces the fastening portion in directions towards and away from the flat conductor; and an operation portion that includes a flat plate portion and a connecting portion, the flat plate portion extending along a front wall, the connecting portion extending from the flat plate portion in the direction away from the flat conductor and connected to the elastic portion. The flat plate portion is pushed along an insertion direction of the flat conductor.

13 Claims, 11 Drawing Sheets

CONNECTOR HAVING EASILY UNFASTENED LOCK LEVER FROM A FLAT CONDUCTOR

BACKGROUND OF THE INVENTION

1. Field of the Invention

The present invention relates to a connector that electrically connects a flat conductor and a substrate to each other.

2. Description of the Related Art

Hitherto, as a connector that is used in an electronic device, a connector that is mounted on a substrate and that electrically connects, for example, a flexible printed circuit (FPC) or a flexible flat cable (FFC) (such circuits are referred to as "flat conductor" in the specification and claims) and the substrate to each other is used. Since such a connector is capable of connecting the substrate and a unit in a device, such as a computer or a liquid crystal display, in various forms, such a connector is installed in many electronic devices.

As such a connector, a connector including a lock lever that includes a fastening portion that is fastened to a recessed portion of a side edge of a flat conductor is available. In a state in which the flat conductor and a terminal are electrically connected to each other, the fastening portion fastened to the recessed portion of the flat conductor to secure the flat conductor to the connector. In removing the flat conductor from the connector, an operation portion of the lock lever is previously pushed to remove the fastening portion from the recessed portion, and, in this state, the flat conductor is pulled from the connector to allow the flat conductor to be easily removed from the connector (refer to, for example, Japanese Unexamined Patent Application Publication No. 2012-59535).

The fastening portion of such a lock lever described above is connected to the operation portion, and is displaced in a direction that is the same as a pushing direction of the operation portion. Therefore, in order to remove the fastening portion from the recessed portion of the flat conductor, it is necessary to displace the operation portion by a large amount in a direction away from the flat conductor by pushing the operation portion. Therefore, when the flat conductor is inserted into the connector in a direction that is orthogonal to a plate surface of a substrate, a wide space for displacing the operation portion needs to be provided in the vicinity of the connector. In addition, when the flat conductor is inserted into the connector in a direction that is parallel to the plate surface of the substrate, a wide space for displacing the operation portion is required in a height direction of the connector. However, when other mounted components are closely disposed in the vicinity of the connector that is mounted on the substrate, such operations are difficult to perform.

SUMMARY OF THE INVENTION

The present invention is achieved with such related art described above being the background of the invention. It is an object of the present invention to provide a connector that allows a lock lever to be easily unfastened from a flat conductor even if a wide space is not provided in the vicinity of the connector.

To this end, the present invention provides the following structures.

According to an aspect of the present invention, there is provided a connector including a terminal that electrically contacts a flat conductor serving as an object to be connected; a housing including an insertion opening for inserting the flat conductor therein, a fitting chamber where the flat conductor and the terminal electrically contact each other, and a side wall portion that forms the fitting chamber; and a lock lever that is fastened to the flat conductor that is fitted to the terminal, and maintains electrical connection between the terminal and the flat conductor. In the connector, the lock lever includes a fastening portion that, in an interior of the fitting chamber, is fastened to the flat conductor that electrically contacts the terminal, and prevents removal of the flat conductor; an elastic portion that displaces the fastening portion in directions towards and away from the flat conductor; and an operation portion that includes a flat plate portion and a connecting portion, the flat plate portion extending along the side wall portion, the connecting portion extending from the flat plate portion in the direction away from the flat conductor and connected to the elastic portion, wherein the flat plate portion is pushed along an insertion direction of the flat conductor, so that the connecting portion pushes the elastic portion in the direction away from the flat conductor and the fastening portion is displaced in the direction away from the flat conductor to unfasten the lock lever from the flat conductor.

Ordinarily, in order to displace the fastening portion in a direction away from the flat conductor, the flat plate portion needs to be displaced in the direction away from the flat conductor. In contrast, according to the present invention, it is possible to unfasten the lock lever from the flat conductor by displacing the fastening portion in the direction away from the flat conductor as a result of pushing the flat plate portion of the lock lever in the insertion direction of the flat conductor. Therefore, for example, even if mounted components are closely disposed in the vicinity of the connector and a space for displacing the operation portion by pushing the operation portion in the direction away from the flat conductor is not provided, it is possible to easily unfasten the lock lever from the flat conductor.

It is possible to provide a stopper including a base end portion that is connected to the operation portion according to the present invention, and being displaced along with the operation portion and contacting the side wall portion to stop the displacement of the operation portion.

When the operation portion is excessively displaced in the direction away from the flat conductor, the operation portion may no longer be capable of returning to its proper position as a result of plastic deformation of the operation portion. This may no longer allow the fastening portion to be fastened to/unfastened from the flat cable. Therefore, when a stopper that is connected to the operation portion is provided as in the present invention, it is possible to reduce the frequency with which the operation portion is excessively displaced. Consequently, it is possible to suppress the occurrence of plastic deformation of the operation portion.

The side wall portion according to the present invention may include a contact section that the stopper strikes in the insertion direction of the flat conductor.

If the stopper strikes the side wall portion in the direction away from the flat conductor, a wide space for displacing the stopper is required. However, since the stopper strikes the contact section in the same direction as the pushing direction of the flat plate portion, it is not necessary to provide such a wide space.

For example, when a plate edge of the side wall portion is the contact section and when the stopper is caused to strike the plate edge, the contact section is thicker and more rigid in the striking direction than when the plate surface of the side wall portion is the contact section. Therefore, it is possible to reduce the frequency with which the contact section is deformed and fractured. Consequently, it is possible to reliably receive a force that is applied from the stopper by the contact section and to stop the displacement of the operation portion.

The stopper according to the present invention may include an extending portion that extends in a cantilever manner from the operation portion.

This makes it possible for the operation portion and the extending portion to be individually elastically displaced. Therefore, for example, while displacing the operation portion in the tilting direction with respect to the side wall portion, it is possible to displace the extending portion along the side wall portion and reliably contact the stopper with the side wall portion.

The stopper according to the present invention may include a plate edge portion that contacts the side wall portion.

When the plate surface of the stopper comes into contact with the side wall portion, the stopper receives an opposing force from the side wall portion in the plate thickness direction of the stopper. In contrast, when the plate edge portion of the stopper comes into contact with the side wall portion, the plate edge portion receives an opposing force in the plate surface direction of the stopper. In this case, the frequency with which the stopper is fractured and deformed by the opposing force is reduced compared to when the plate surface of the stopper comes into contact with the side wall portion. Consequently, it is possible to reliably bring the stopper into contact with the side wall portion and to stop the displacement of the operation portion.

The side wall portion according to the present invention may include a thick-walled portion that protrudes in a plate thickness direction of the side wall portion and that the stopper contacts.

This makes it possible to increase the rigidity of the side wall portion with respect to a force that is applied from the stopper. Therefore, it is possible to reduce the frequency with fracturing and deformation occur due to contact of the stopper.

It is possible for the housing according to the present invention to include a plurality of the thick-walled portions, the operation portion to be disposed between the thick-walled portions, and an interval between the thick-walled portions to be less than a plate width of the flat conductor.

By providing the operation portion between the thick-walled portions, it is possible to guide the displacement of the operation portion by the thick-walled portions. In addition, by causing the distance between the thick-walled portions to be less than the plate width of the flat conductor, it is possible to reduce the frequency with which an operator accidentally inserts the flat conductor into a location between the thick-walled portions instead of into the fitting chamber.

It is possible for the flat plate portion according to the present invention to be pushed, the connecting portion to be displaced so as to approach the elastic portion, and the side wall portion to include a guide surface portion that guides the displacement of the flat plate portion in a direction towards the connecting portion.

This makes it possible to reduce the frequency with which the operation portion comes into contact with the side wall portion and is prevented from becoming displaced even if the operation portion as a whole is displaced such that the connecting-portion-side of the operation portion approaches the side wall portion.

It is possible for the operation portion according to the present invention to include a push portion that is connected to the flat plate portion and that is subjected to the pushing, and the push portion to be provided at a top surface side of the housing.

This makes it possible for an operator to easily touch the push portion and to easily perform a pushing operation.

The lock lever according to the present invention may include a housing securing portion that is secured to the housing and a substrate securing portion that is exposed from an opposing side wall portion opposing the side wall portion and that is secured to the substrate.

Therefore, even if the flat plate portion of the lock lever is pushed along the insertion direction of the flat conductor at a side of one side surface of the housing, since the substrate securing portion is firmly secured to the substrate at a side of the opposite side surface of the housing, it is possible to prevent the one side surface of the housing from falling towards the substrate.

The side wall portion according to the present invention may include a leg that contacts the substrate and that supports the housing.

Therefore, even if the flat plate portion of the lock lever is pushed along the insertion direction of the flat conductor, since the leg supports the housing while in contact with the substrate, it is possible to prevent the housing from falling.

The present invention makes it possible to provide a connector that allows a lock lever to be easily unfastened from a flat conductor. Therefore, even if, for example, the connector is mounted at a location where mounted components are closely disposed, it is possible to easily unfasten the lock lever from the flat conductor.

DESCRIPTION OF THE PREFERRED EMBODIMENTS

Figure 1:
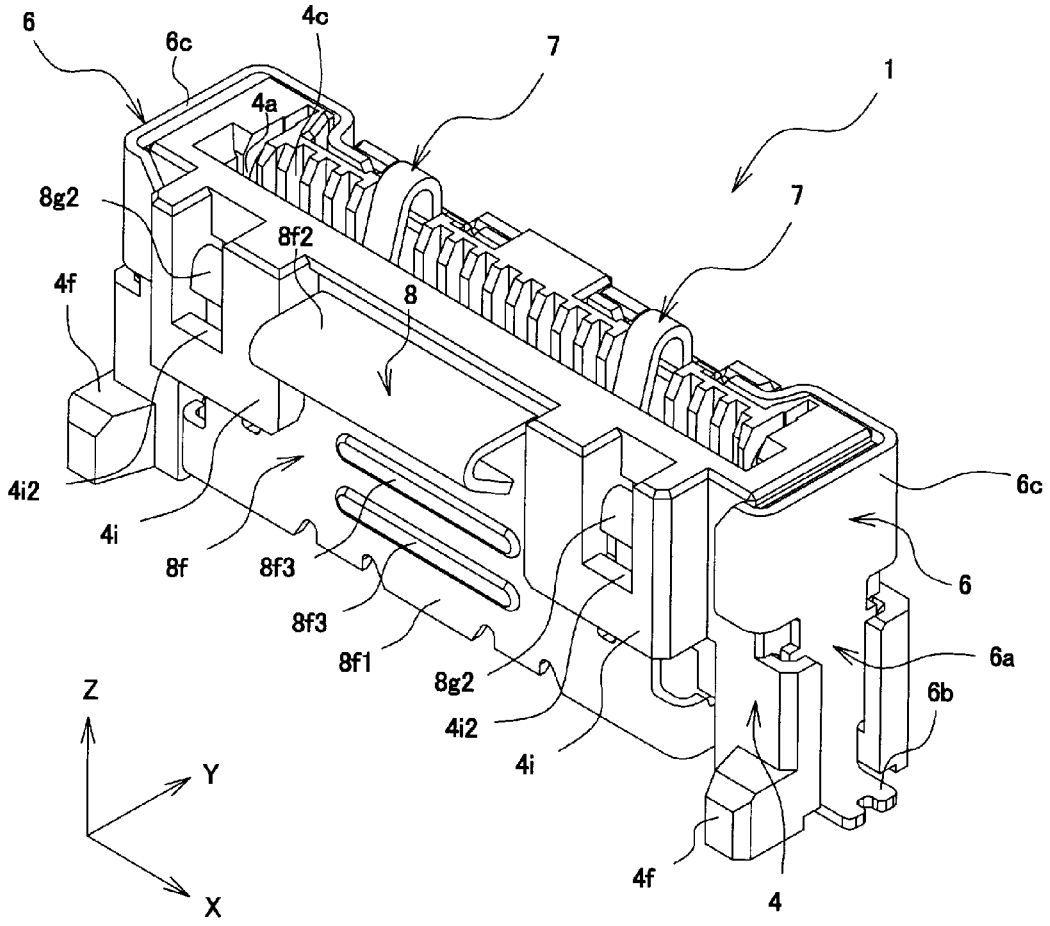
FIG. 1 is an external perspective view of a connector according to an embodiment.
Figure 2:
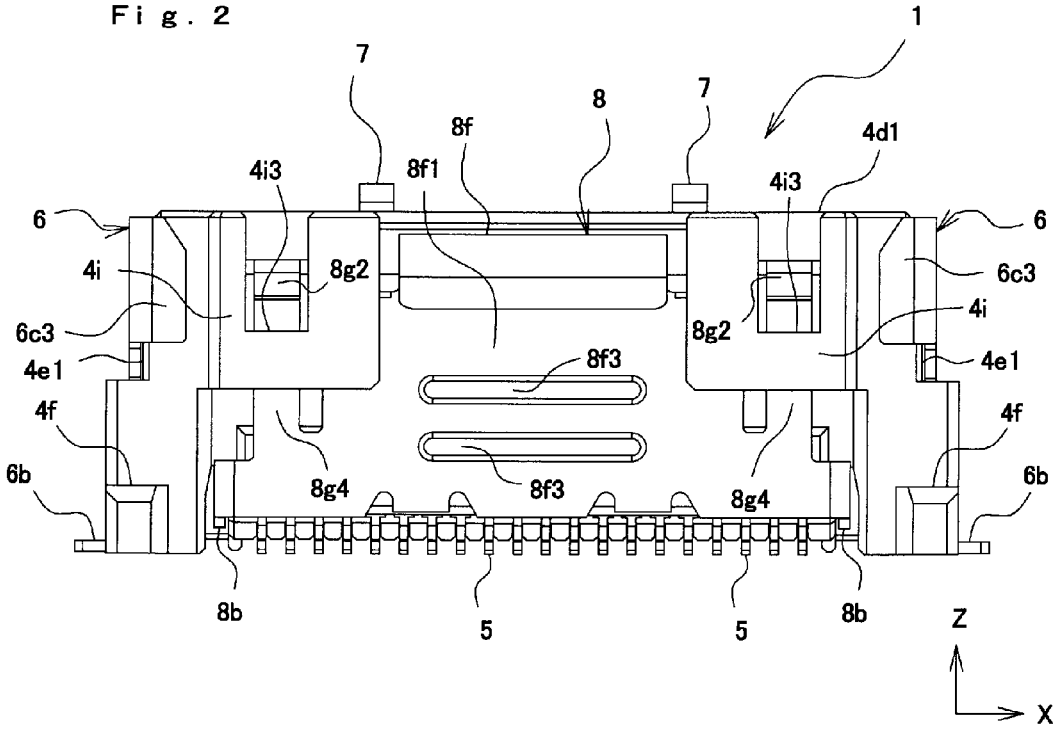
FIG. 2 is a front view of the connector shown in FIG. 1.
Figure 3:
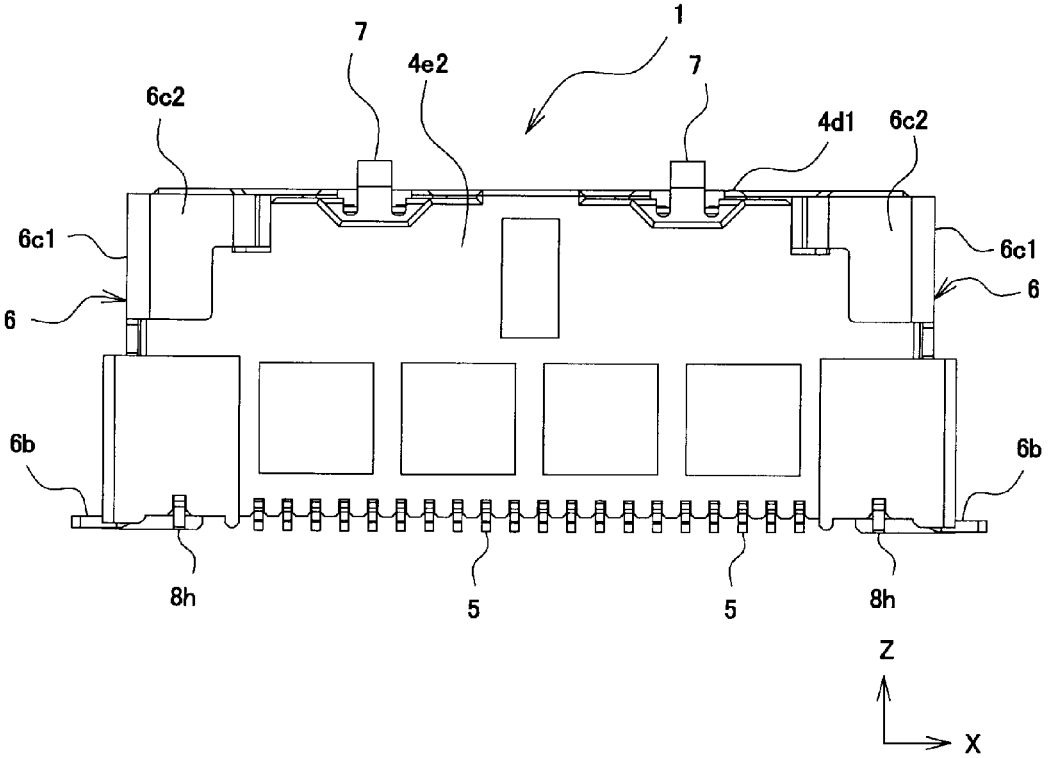
FIG. 3 is a back view of the connector shown in FIG. 1.
Figure 4:
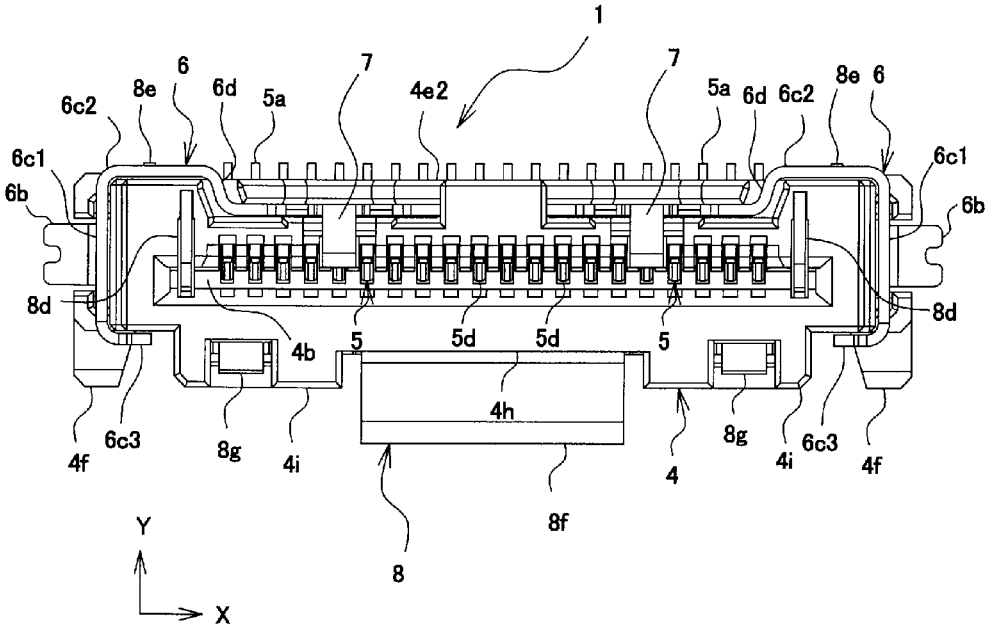
FIG. 4 is a plan view of the connector shown in FIG. 1.
Figure 5:
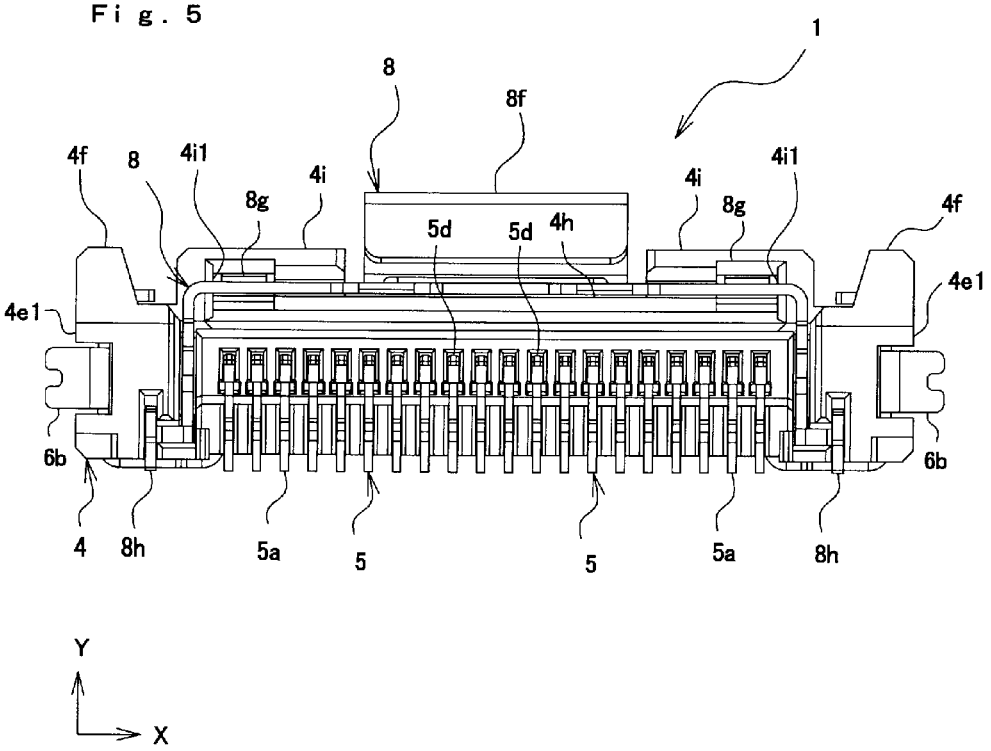
FIG. 5 is a bottom view of the connector shown in FIG. 1.
Figure 6:
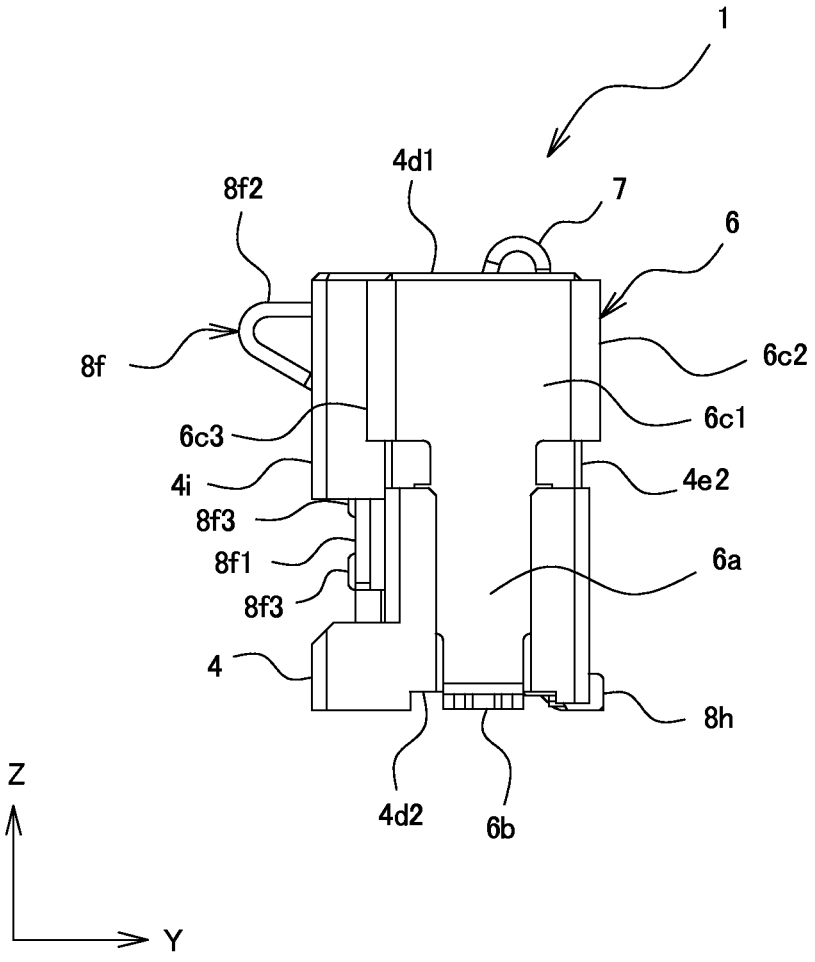
FIG. 6 is a right view of the connector shown in FIG. 1.

A preferred embodiment of a connector according to the present invention is described with reference to the drawings. A connector 1 in the embodiment below is mounted on a substrate 2, and electrically connects a flat conductor 3, such as an FPC or an FFC, to a substrate circuit.

In the specification, a width direction (long-side direction) of the connector 1 is a direction X, a front-back direction (short-side direction) is a direction Y, and a height direction (up-down direction) of the connector 1 is a direction Z. In the front-back direction Y of the connector 1, a side where a lock lever 8 is provided is a front side, and the opposite side is a back side. In the height direction Z, a side where the substrate 2 is provided is a lower side, and a side where the connector 1 is provided is an upper side. However, these definitions do not limit the method of mounting the connector 1 on the substrate 2 and the method of use.

Since the left view is symmetrical with the right view in the left-right direction, the left view is not shown. In addition, since two reinforcing members 6 of the connector 1 are symmetrically formed in the left-right direction, the external perspective view of one of the two reinforcing members 6 is not shown.

Embodiment (FIGS. 1 to 12)

The connector 1 according to the embodiment is a connector in which, with the connector 1 being vertically placed on and secured to the substrate 2, the flat conductor 3 is inserted to electrically connect the substrate 2 and the flat conductor 3 to each other. The length of the connector 1 in the front-back direction is less than the length of the connector 1 in the height direction Z. The flat conductor 3 is inserted into a fitting chamber 4*b* along the height direction Z from an insertion opening 4*a* that is provided in the upper side of the connector 1.

The connector 1 is mounted on the substrate 2, and electrically connects the flat conductor 3 and the substrate 2 to each other. As shown in FIGS. 1 to 6, the connector 1 includes a housing 4, terminals 5, the reinforcing members 6, ground terminals 7, and a lock lever 8.

First, a structure of the flat conductor 3, which is an object to be connected to the connector 1, according to the embodiment is described.

Flat Conductor

The flat conductor 3 includes a conductive wire 3*a*, an insulating layer 3*b*, fastening recessed portions 3*c*, and a ground connecting portion 3*d*.

Figure 12A:
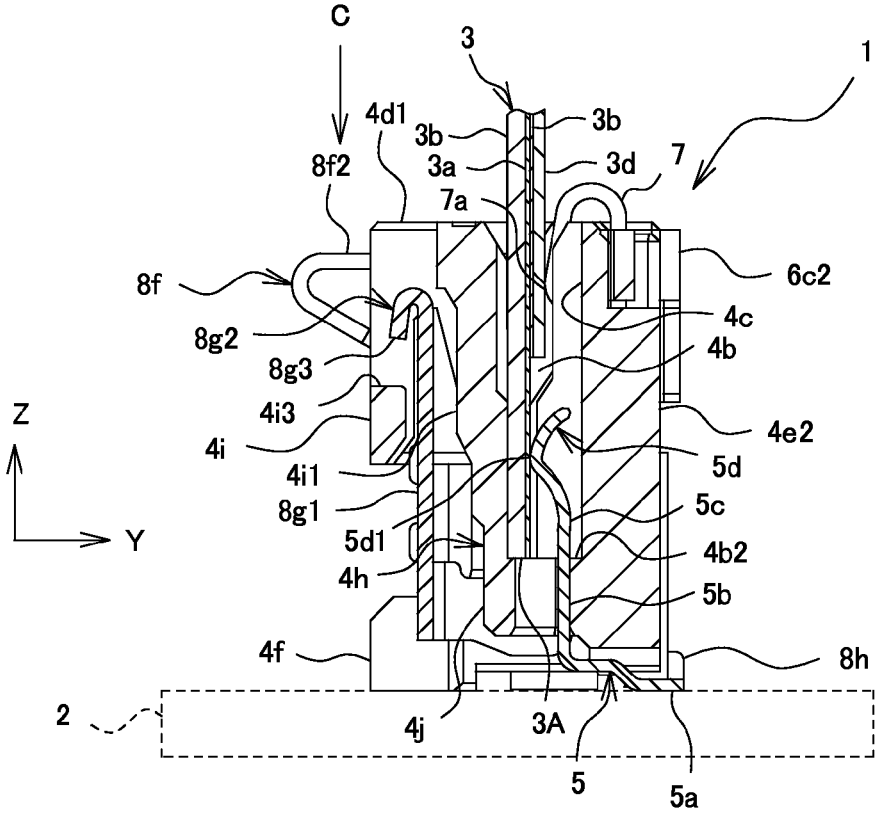
FIGS. 12A and 12B are each a sectional view taken in the direction of arrows along line XII-XII shown in FIG. 10, with FIG. 12A showing a state in which a contact edge section is separated from an opening edge and FIG. 12B showing a state in which the contact edge section strikes the opening edge.
Figure 12B:
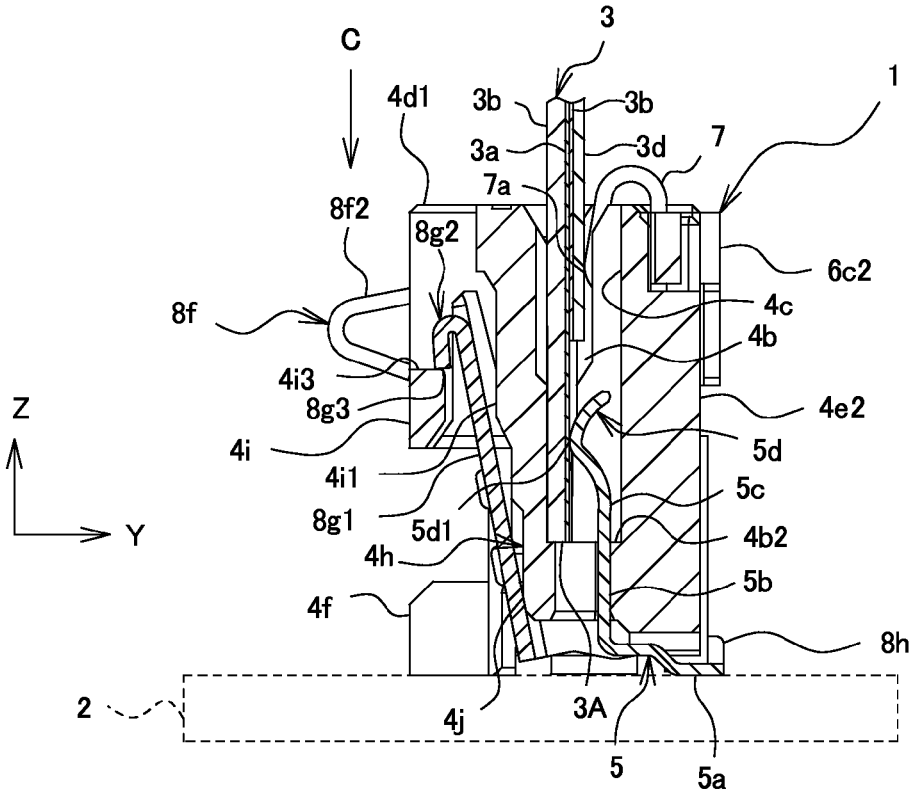

As shown in FIGS. 12A-12B, the conductive wire 3*a* is such that its front and back surfaces are covered by the insulating layer 3*b*, and such that a side of an insertion end that is inserted into the housing 4 (leading end side) is exposed to the outside of the insulating layer 3*b* from the insulating layer 3*b*. This exposed portion of the conductive wire 3*a* electrically contacts the terminals 5 of the connector 1.

The insulating layer 3*b* is formed of an insulating covering, and is formed by being placed on the front and back surfaces of the conductive wire 3*a* as mentioned above.

Figure 9:
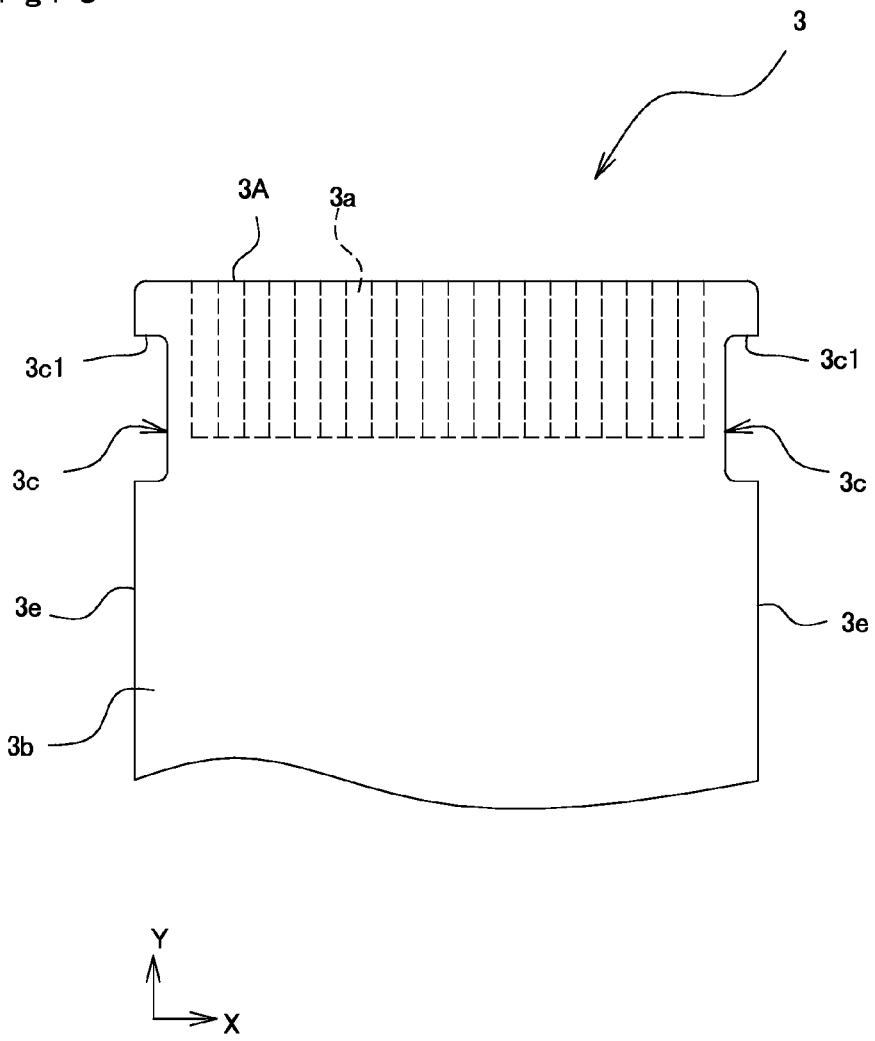
FIG. 9 is a plan view of a flat connector that the connector shown in FIG. 1 is electrically contacts.
Figure 10:
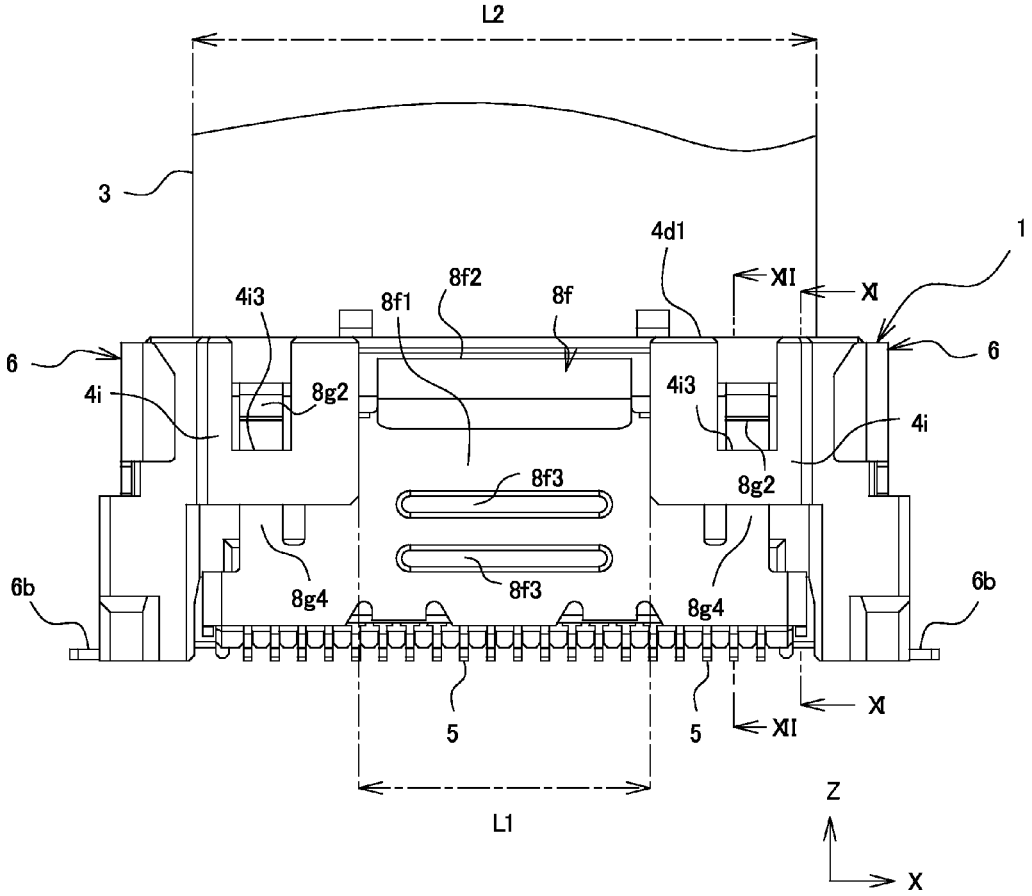
FIG. 10 is an explanatory view of a state in which the connector shown in FIG. 1 electrically contacts the flat conductor.

As shown in FIG. 9, the two fastening recessed portions 3*c* are provided, one at a side edge portion 3*e* so as to be adjacent to a leading end portion 3A and the other at the other side edge portion 3*e* so as to be adjacent to the leading end portion 3A. The two side edge portions 3*e* are provided along an insertion direction of the flat conductor 3. Each fastening recessed portion 3*c* is formed as a cutaway portion that is formed by cutting away its corresponding side edge portion 3*e* of the flat conductor 3 in a recessed form. Each fastening recessed portion 3*c* includes an edge portion 3*c*1, which is a plate edge along the width direction X of the flat conductor 3. Fastening portions 8*a* of the lock lever 8 (described later) are fastened to the respective edge portions 3*c*1 and 3*c*1.

A structure of the connector 1 according to the embodiment is hereunder described.

Housing

The housing 4 is formed of insulating resin. As shown in FIGS. 1 to 6, the housing 4 has a substantially parallelepiped shape, with its length in the front-back direction Y being less than its length in the height direction Z. The housing 4 includes the insertion opening 4*a* for the flat conductor 3, the fitting chamber 4*b*, a terminal accommodation portions 4*c*, legs 4*f*, and a front wall 4*h* serving as a side wall portion.

The insertion opening 4*a* is formed in a top wall 4*d*1 at the upper side of the housing 4, and communicates with the fitting chamber 4*b*.

The fitting chamber 4*b* is provided in the interior of the housing 4, and is formed so as to be surrounded by an inner wall 4*b*1 that is provided along the height direction Z.

The terminal accommodation portions 4*c* communicate with the fitting chamber 4*b*, and are disposed side by side along the width direction X of the housing 4 and behind the fitting chamber 4*b*. Each terminal accommodation portion 4*c* accommodates one terminal 5.

The front wall 4*h* forms the inside wall 4*b*1 of the fitting chamber 4*b* in front of the flat conductor 3 in a fitted state. The front wall 4*h* includes thick-walled portions 4*i* and the legs 4*f*.

The thick-walled portions 4*i* are provided, one at an end side at the upper side of the front wall 4*h* and the other at the other end side at the upper side of the front wall 4*h*. The two end sides are provided in the width direction X. Each thick-walled portion 4*i* is formed with a substantially parallelepiped shape so as to protrude towards the front. Each thick-walled portion 4*i* has a through hole 4*i*1 along the height direction Z. An opening portion 4*i*2 of each through hole 4*i*1 is provided with an opening edge 4*i*3 that is provided as a contact section. A push portion 8*f*2 (described later) is disposed between the two thick-walled portions 4*i*.

The legs 4*f* are provided, one at the end side at the lower end side of the front wall 4*h* and the other at the other end side at the lower end side of the front wall 4*h*. The end sides are provided in the width direction X. Each leg 4*f* is formed so as to protrude towards the front. Lower ends of the corresponding legs 4*f* contact a surface of the substrate 2 while the connector 1 is mounted on the substrate 2.

When the legs 4*f* protrude forwardly from the front wall 4*h*, it is possible to reduce the frequency with which the connector 1, which is a vertically placed type that tends to fall towards the front and back because its length in the front-back direction Y is less than its length in the height direction Z, falls towards the front, and to reliably secure the connector 1 to the substrate 2.

Terminals

Each terminal 5 is formed by bending a conductive metallic plate. Each terminal accommodating portion 4*c* accommodates one terminal 5, so that a plurality of terminals 5 are disposed side by side along the width direction X of the housing 4. As shown in FIG. 12, each terminal 5 includes a substrate connection portion 5*a*, a securing portion 5*b*, an elastic portion 5*c*, and a contact portion 5*d*.

Each substrate connection portion 5*a* is provided at one end of its corresponding terminal 5, and protrudes towards the back of the housing 4. The substrate connection portions 5*a* of the respective terminals 5 are soldered to the substrate 2. Therefore, it is possible to reduce the frequency with which the connector 1 that tends to become unstably secured due to its length in the front-back-direction Y being less than its length in the height direction Z falls towards the back, and to reliably secure the connector 1 to the substrate 2.

The securing portions 5*b* are connected to the substrate connection portions 5*a*. By press-fitting the securing portions 5*b* to securing holes (not shown) in the housing 4, the securing portions 5*b* are secured to the housing 4. The securing portions 5*b* extend along the height direction Z. A lower end of each securing portion 5*b* is connected to its corresponding substrate connection portion 5*a*. The securing portions 5*b* extend through a far-side wall 4*b*2 at the lower side of the housing 4, and the terminals 5 are secured to the housing 4 here. In the embodiment, the terminals 5 and the housing 4 are integrally formed by insert molding.

The elastic portions 5*c* extend upward from top ends of the respective securing portions 5*b* and in a cantilever manner along the height direction Z. The contact portions 5*d* are elastically supported at end sides of the respective elastic portions 5*c*. In the interior of the fitting chamber 4*b*, each elastic portion 5*c* is elastically deformed along the front-back direction Y of the connector 1 with a connection portion of each elastic portion 5*c* with its corresponding securing portion 5*b* being a fulcrum.

Each contact portion 5*d* is bent in the form of a mountain in a direction of contact with the flat conductor 3, and includes a contact portion 5*d*1 that is electrically connected to the flat conductor 3. The contact portions 5*d*1 electrically contact the flat conductor 3 in the interior of the fitting chamber 4*b*.

Reinforcing Members

The two reinforcing members 6 are each formed of a conductive metallic plate. The reinforcing members 6 are provided at the respective end sides in the width direction X of the housing 4. Referring to FIGS. 1 to 5 and 7, the reinforcing members 6 are secured to the respective end sides in the width direction X of the housing 4. The pair of reinforcing members 6 and 6 are symmetrically formed on the right and left, and reinforce a wall body 4*g* of the housing 4 that forms the fitting chamber 4*b*.

Each reinforcing member 6 includes a securing portion 6*a* with respect to the housing 4, a ground connecting portion 6*b*, and a reinforcing body 6*c*.

Each securing portion 6*a* has a plate surface along the height direction Z, and is press-fitted to a press-fit groove (not shown) at the lower side of a corresponding lateral side wall 4*e*1 at the wall body 4*g*. The reinforcing members 6 are secured to the housing 4 by the securing portions 6*a*.

The ground connecting portions 6*b* are connected to the lower sides of the respective securing portions 6*a*. With the connector 1 being mounted on the substrate 2, each ground connecting portion 6*b* includes a plate surface that contacts a surface of the substrate. Each ground connecting portion 6*b* protrudes along the width direction X at the lower side of the housing 4, and is soldered to a ground connecting pad (not shown) of the substrate 2.

Each reinforcing body 6*c* is connected to the upper side of its corresponding securing portion 6*a*, and includes a first reinforcing plate 6*c*1, a second reinforcing plate 6*c*2, and a third reinforcing plate 6*c*3.

At the end side in the width direction X of the housing 4, each first reinforcing plate 6*c*1 is provided along its corresponding lateral side wall 4*e*1. Each third reinforcing plate 6*c*3 is formed along a plate surface of the front wall 4*h* by bending a front end side of its corresponding first reinforcing plate 6*c*1.

Each second reinforcing plate 6*c*2 is connected to a back end portion of its corresponding first reinforcing plate 6*c*1, and is provided along a back side wall 4*e*2 opposing the front wall 4*h*. The second reinforcing plates 6*c*2 and the respective third reinforcing plates 6*c*3 sandwich end portion sides in the width direction X of the housing 4. Each second reinforcing plate 6*c*2 includes a stepped portion 6*d* at a substantially central portion thereof in the width direction X. A side of each reinforcing member 6 that is situated closer to the first reinforcing plate 6*c*1 than the stepped portion 6*d* is exposed to the outside from the housing 4, and an opposite side of each reinforcing member 6 is accommodated at an inner portion of the back side wall 4*e*2.

Ground Terminals

Figure 7:
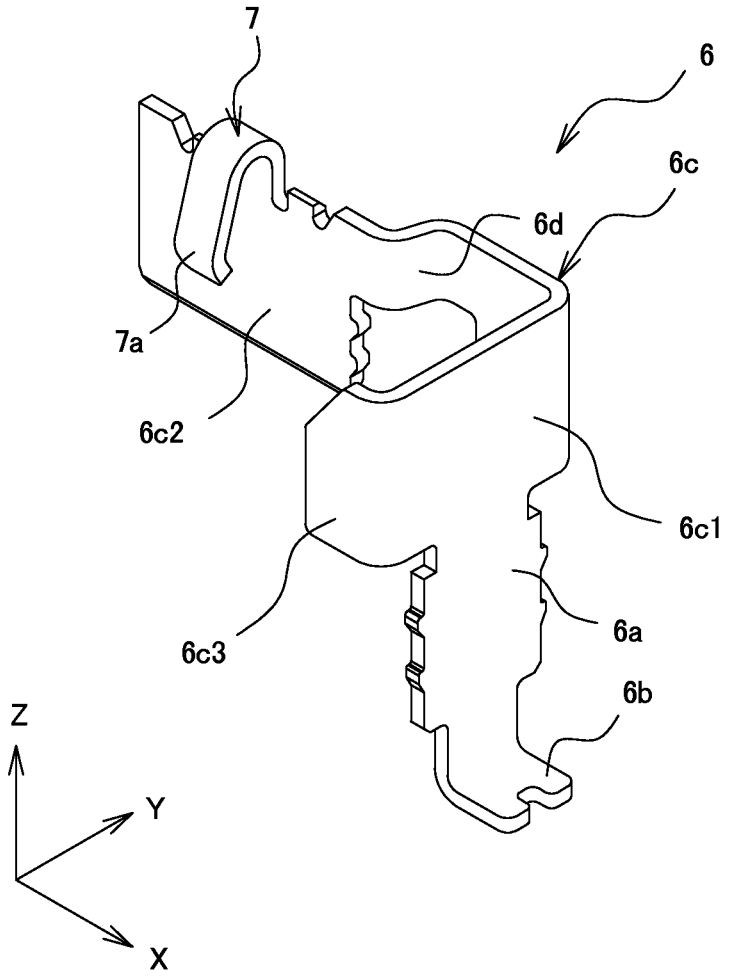
FIG. 7 is an external perspective view of a reinforcing member of the connector shown in FIG. 1.

The ground terminals 7 are formed of conductive metallic pieces, and, as shown in FIG. 7, are integrally formed with the reinforcing members 6.

Each ground terminal 7 is formed into a substantially U shape by extending upward from the second reinforcing plate 6*c*2 of its corresponding reinforcing member 6 and in a cantilever manner, bending towards the front in the front-back direction Y, and extending downward. An end side of each ground terminal 7 is provided in the fitting chamber 4*b*. Each end side is provided with a bend portion 7*a* that is bent in the form of a mountain in a direction of contact with the flat conductor 3 in a fitted state, and contacts the ground connecting portion 3*d* of the flat conductor 3.

By integrally forming the ground terminals 7 with the reinforcing members 6 in this way, it is possible to mount the ground terminals 7 and the reinforcing terminals 6 on the housing 4 by one operation. Therefore, it is possible to increase the assembly work efficiency and to reduce the number of parts compared to when the ground terminals 7 and the reinforcing members 6 are formed as separate members.

Lock Lever

Figure 8:
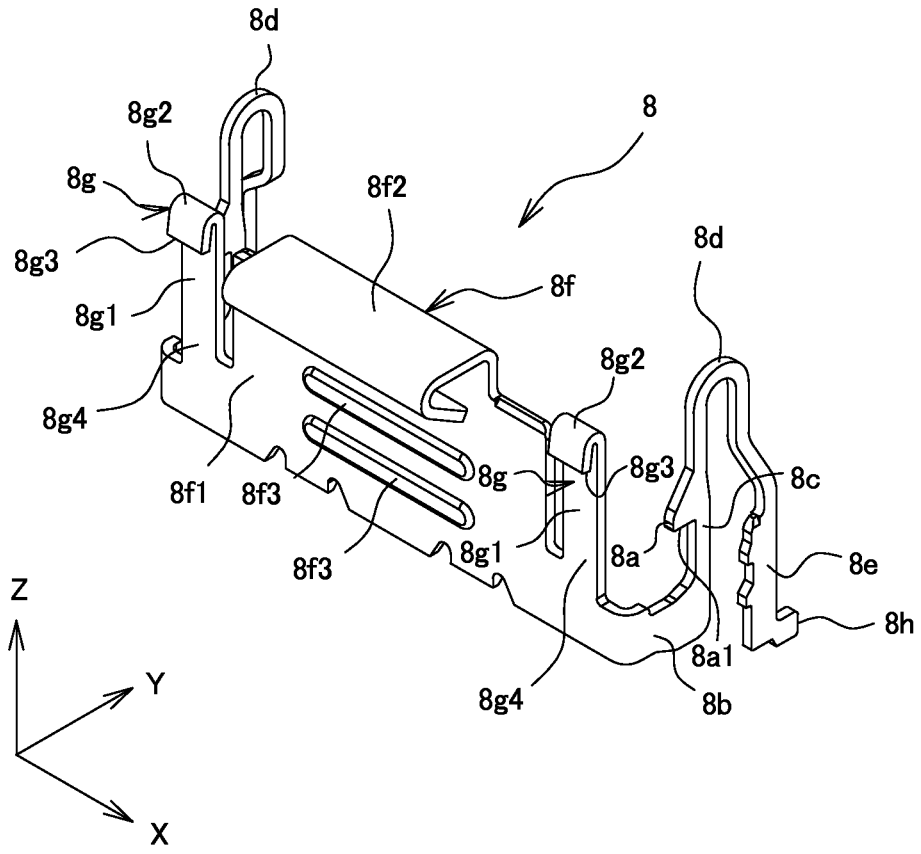
FIG. 8 is an external perspective view of a lock lever of the connector shown in FIG. 1.
Figure 11A:
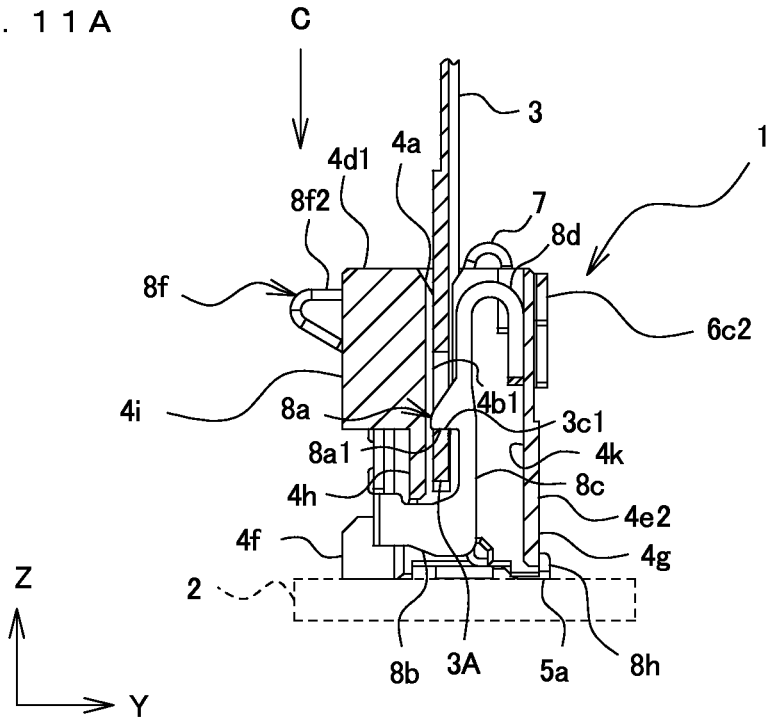
FIGS. 11A and 11B are each a sectional view taken in the direction of arrows along line XI-XI shown in FIG. 10, with FIG. 11A showing a state in which a fastening portion of a lock lever is fastened to the flat conductor and FIG. 11B showing a state in which the fastening portion of the lock lever is unfastened from the flat conductor.
Figure 11B:
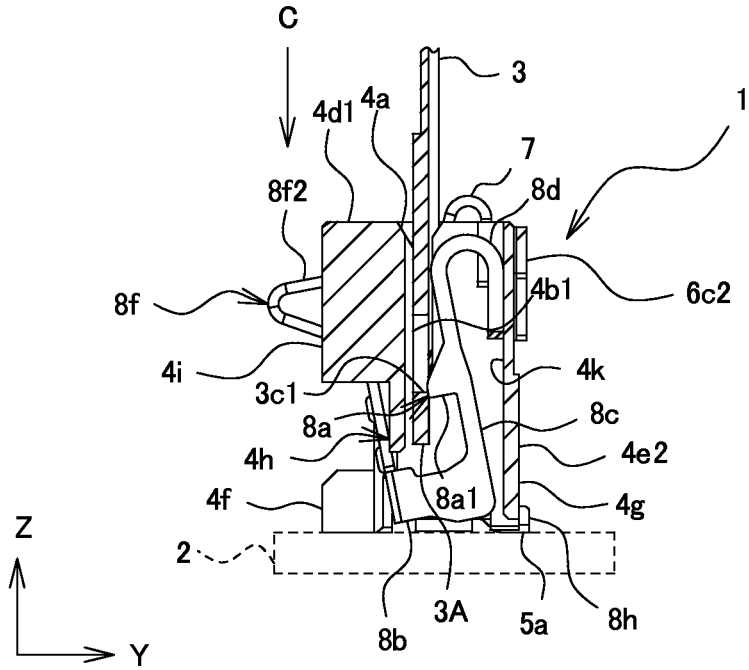

The lock lever 8 is formed by bending a metallic plate. As shown in FIGS. 8 and 11A and 11B, the lock lever 8 includes two substrate securing portions 8*h*, two housing securing portions 8*e*, two bend portions 8*d*, two elastic portions 8*c*, two connecting portions 8*b*, two fastening portions 8*a*, one operation portion 8*f*, and two stoppers 8*g*.

The substrate securing portions 8*h* are provided, one at one end side of the lock lever 8 and the other at the other end side of the lock lever 8. The end sides are provided in the width direction X. Each substrate securing portion 8*h* is a plate portion having a plate surface in a plane Y-Z. Each substrate securing portion 8*h* has a plate edge that is parallel to the substrate 2. By soldering the substrate securing portions 8*h* to the substrate 2, the lock lever 8 is secured to the substrate 2.

The housing securing portions 8*e* are each a plate portion that is connected to the respective substrate securing portions 8*h*, extends upward along the height direction Z, and has a plate surface in a plane Y-Z. The upper side of each housing securing portion 8*e* is provided with a protrusion. Each protrusion is press-fitted and secured to its corresponding securing groove (not shown) that is provided in the interior of the wall body 4*g* at the lateral side wall 4*e*1 of the housing 4.

The substrate securing portions 8*h* and the housing securing portions 8*e* are provided such that one substrate securing portion 8*h* and one housing securing portion 8*e* are disposed at one end side of the terminals 5 in the embodiment and such that the other substrate securing portion 8*h* and the other housing securing portion 8*e* are disposed at the other end side of the terminals 5 in the embodiment. The end sides are provided in the width direction X. However, when the substrate securing portions 8*h* and the housing securing portions 8*e* are formed as plate portions each having a plate surface in the Y-Z plane as mentioned above, it is possible prevent the connector from increasing in size in the width direction X.

The bend portions 8*d* are provided, one at the upper side of its corresponding housing securing portion 8*e* so as to be connected therewith and the other at the upper side of its corresponding housing securing portion 8*e* so as to be connected therewith. Each bend portion 8*d* is formed in a substantially U shape so as to protrude upward in the height direction Z. Each bend portion 8*d* is provided closer to the center than its corresponding housing securing portion 8*e* in the width direction X by one step. Therefore, whereas the housing securing portions 8*e* are secured in the interior of the wall body 4*g* at the lateral side wall 4*e*1 of the housing 4, the bend portions 8*d* are accommodated in a displacement space 4*k* that is provided at an inner side of the wall body 4*g* and that communicates with the fitting chamber 4*b*, and are elastically deformable.

The elastic portions 8*c* are plate portions, are provided such that one is connected to its corresponding bend portion 8*d* and the other is connected to its corresponding bend portion 8*d*, and extend downward along the height direction Z. The elastic portions 8*c* are accommodated in the displacement space 4*k* that is provided at the wall body 4*g*, and can be elastically displaced in the interior of the displacement space 4*k*.

The connecting portions 8*b* are each a plate portion that is connected to the lower side of its corresponding elastic portion 8*c*, and that extends along the front-back direction Y at a location between its corresponding elastic portion 8*c* and a flat plate portion 8*f*1 (described later). The connecting portions 8*b* are disposed below the leading end portion 3A of the flat conductor 3 in a fitted state.

The fastening portions 8*a* are provided so as to protrude into the interior of the fitting chamber 4*b* from the inner wall 4*b*1 of the fitting chamber 4*b*. At substantially the centers in the height direction Z of the elastic portions 8*c*, the respective fastening portion 8*a* are formed in the form of a mountain protruding towards the front. Each fastening portion 8*a* has a fastening edge 8*a*1 along the height direction Z.

The operation portion 8*f* is connected to one of the connecting portions 8*b* at one end side and to the other connecting portion 8*b* at the other end side. The end sides are provided in the width direction X. The operation portion 8*f* is provided between the two elastic portions 8*c*. The operation portion 8*f* is provided outside of the housing 4, and includes the flat plate portion 8*f*1 and the push portion 8*f*2.

The flat plate portion 8*f*1 is connected to the connecting portions 8*b*, and has a substantially plate shape extending upward. The push portion 8*f*2 that has a plate surface which is bent towards the front and which is parallel to the substrate 2 is formed at the upper end side of the flat plate portion 8*f*1. The flat plate portion 8*f*1 includes two protrusions 8*f*3 extending along the width direction X at substantially the center thereof in the height direction Z. This makes it possible to increase the rigidity of the flat plate portion 8*f*1 with respect to a force that is applied when the push portion 8*f*2 is pushed.

The push portion 8*f*2 is provided so as to protrude beyond front ends of the thick-walled portions 4*i* of the housing 4. The push portion 8*f*2 is disposed above the center of the housing 4 in the height direction Z and adjacent to the top wall 4*d*1. The push portion 8*f*2 is such that its leading end portion is further bent downward and backward.

The stoppers 8*g* are provided, one at one end side of the operation portion 8*f* and the other at the other end side of the operation portion 8*f*. The end sides are provided in the width direction X. Each stopper 8*g* includes an extending portion 8*g*1 that extends upward from the operation portion 8*f* and in a cantilever manner and a contact section 8*g*2 that is provided at an end side of the corresponding extending portion 8*g*1. Each contact section 8*g*2 is formed in a substantially U shape in which an end side of the metallic plate is bent downward, with a contact edge section 8*g*3 being provided at a downwardly facing plate edge that is provided at an end of the metallic plate.

Each extending portion 8*g*1 is inserted into the through hole 4*i*1 of its corresponding thick-walled portion 4*i* at the front wall 4*h*. Each base end portion 8*g*4 is disposed outside of its corresponding through hole 4*i*1. The contact sections 8*g*2 and the contact edge sections 8*g*3 are exposed to the outside from the opening portions 4*i*2 of the respective through holes 4*i*1.

As described above, in the embodiment, each substrate securing portion 8*h* is provided at one side of its corresponding housing securing portion 8*e*; for example, each bend portion 8*d* and each elastic portion 8*c* are provided at the other side of the corresponding housing securing portion 8*e*; and the operation portion 8*f* is provided at the other side of the housing securing portions 8*e*. Therefore, even if a force is applied to the elastic portions 8*c* and the bend portions 8*d* as a result of pushing the push portion 8*f*2 and displacing the operation portion 8*f*, this force is received by the housing securing portions 8*e*, so that the frequency with which the force is applied to the substrate securing portions 8*h* is reduced. Consequently, even if the push portions 8*f*2 is pushed, the frequency with which the substrate securing portions 8*h* are removed from the substrate 2 is reduced.

Description of Method for Fitting Flat Conductor

Next, a method of use the connector 1 is described.

First, as shown in FIG. 7, the flat conductor 3 is inserted into the fitting chamber 4*b* from the insertion opening 4*a*. The leading end portion 3A of the flat conductor 3 comes into contact with the fastening portions 8*a* of the lock lever 8, causes the bend portions 8*d* to be elastically deformed such that the fastening portions 8*a* are displaced towards the back, and moves beyond the fastening portions 8*a*. Here, although the fastening portions 8*a* are elastically displaced towards the back, restoring forces that return the fastening portions 8*a* towards to the front act upon the elastic portions 8*c* while the fastening portions 8*a* are elastically displaced backwards. Therefore, the flat conductor 3 is pushed towards the front by the fastening portions 8*a*. In this state, while the flat conductor 3 is moved along the inner wall 4*b*1 at the front side of the fitting chamber 4*b*, the flat conductor 3 is inserted into the fitting chamber 4*b* of the connector 1.

Here, the housing 4 is pushed by the flat conductor 3 that is pushed by the fastening portions 8*a*. However, since the reinforcing members 6 are secured to the housing 4, the rigidity with respect to a force that is applied from the inner side to the outer side of the fitting chamber 4*b* is increased. Therefore, even if the wall body 4*g* receives a force from the flat conductor 3 that is inserted into the fitting chamber 4*b*, the frequency with which the wall body 4*g* is deformed is reduced.

Thereafter, when, with the fastening portions 8*a* of the lock lever 8 being elastically displaced, the flat conductor 3 is further inserted into the fitting chamber 4*b*, the leading end portion 3A of the flat conductor 3 comes into contact with the contact portions 5*d* of the terminals 5 from the upper sides thereof, elastically deforms the contact portions 5*d* towards the back, and moves beyond the contact portions 5*d*1. In this state, the flat conductor 3 is sandwiched by the contact portions 5*d*1 and the inner wall 4*b*1 at the front side of the fitting chamber 4*b*, so that the flat conductor 3 and the terminals 5 electrically contact each other.

Structure of Preventing Removal of Flat Conductor

As described above, when the flat conductor 3 is inserted to the bottom of the fitting chamber 4*b*, the fastening recessed portions 3*c* eventually reach the fastening portions 8*a* of the lock lever 8 that are elastically displaced towards the back. Then, the fastening portions 8*a* are displaced towards the front by the restoring forces, and enter the fastening recessed portions 3*c* from the back. Here, the fastening edges 8*a*1 of the fastening portions 8*a* of the lock lever 8 are in a state in which they are disposed along the front-back direction Y, that is, in a state in which they are disposed in a direction orthogonal to the insertion direction of the flat conductor 3. By causing the fastening edges 8*a*1 to contact and to be fastened to the edge portions 3*c*1 of the fastening recessed portions 3*c*, the connector 1 is prevented from being removed (FIG. 11A).

When a force is applied to the flat conductor 3 in a direction in which the flat conductor 3 is removed while the flat conductor 3 is prevented from being removed from the connector 1, the fastening portions 8*a* of the lock lever 8 contact the edge portions 3*c*1 of the fastening recessed portions 3*c* of the flat conductor 3 and are prevented from being removed, so that it is possible to maintain the connector 1 and the flat conductor 3 in a state of connection.

By soldering the substrate securing portions 8*h* to the substrate 2, the lock lever 8 is secured to the substrate 2. Whereas the operation portion 8*f* of the lock lever 8 is provided at a side of the front wall 4*h*, the substrate securing portions 8*h* are exposed to the outside of the housing 4 at a side of the back side wall 4*e*2 and is secured to the substrate 2. Therefore, it is possible to reduce the frequency with which the connector 1 falls towards the front when the operation portion 8*f* is pushed downward.

The terminals 5 are soldered to the substrate 2 at the lower side of the back side wall 4*e*2 at a side opposite to the side where the operation portion 8*f* of the lock lever 8 is provided. Since the terminals 5 are also secured to the housing 4 by the housing securing portions 8*e*, it is possible to, similarly, reduce the frequency with which the entire connector 1 falls towards the front when the operation portion 8*f* of the lock lever 8 is pushed downward.

Accordingly, according to the connector 1 of the embodiment, since the flat conductor 3 can be prevented from being removed without providing a separate member, such as an actuator or a slider, it is possible to reduce the size of the connector 1.

When the flat conductor 3 is inserted into the fitting chamber 4*b*, the flat conductor 3 is fitted by passing it along a surface of the inner wall 4*b*1 of the fitting chamber 4*b* of the housing 4, itself, instead of along a member having a movable structure in which rattling of, for example, an actuator or a slider may occur. Therefore, it is possible to maintain a reliable fitted state without problems, such as the occurrence of rattling. Further, since the flat conductor 3 can be prevented from being removed by only one operation, that is, the operation of inserting the flat conductor 3 into the connector 3, the fitting operation is facilitated.

Method for Removing Flat Conductor

A connector of a vertically placed type in which the flat conductor 3 is inserted in a direction orthogonal to the substrate 2 may be a tall connector whose length in the height direction Z is greater than its length in the front-back direction Y. Such a connector of a vertically placed type tends to fall towards the substrate 2 because its amount of protrusion from the substrate 2 is large. Therefore, when the connector 1 receives a strong force in the front-back direction Y, the connector 1 may fall towards the opposite side. When other mounted components are provided nearby on the substrate 2, a wider space in a plate surface direction of the substrate 2 is not required when the lock lever 8 is pushed in the height direction Z than when the lock lever 8 is pushed in the front-back direction Y, as a result of which the pushing operation is easily performed. Therefore, in the embodiment, by pushing the push portion 8*f*2 in the height direction Z, it is possible to unfasten the fastening portions 8*a* from the fastening recessed portions 3*c* of the flat conductor 3.

When the flat conductor 3 is to be removed, the push portion 8*f*2 is pushed so as to be pushed downward from thereabove as indicated by arrow C. By this, as shown in FIG. 11B, the bend portions 8*d* are elastically deformed, and the operation portion 8*f*, the stoppers 8*g*, and the elastic portions 8*c* rotate around the bend portions 8*d* as fulcra. This causes the lower side of the flat plate portion 8*f*1 of the operation portion 8*f* and lower sides of the stoppers 8*g* to tilt so as to approach the flat conductor 3 in a fitted state. Then, the connecting portions 8*b* are pushed by the operation portion 8*f*, and are displaced backwards at a location below the flat conductor 3 in the fitted state. Further, the elastic portions 8*c* are pushed by the connecting portions 8*b*, and the lower sides of the elastic portions 8*c* are displaced away from the flat conductor 3 in the fitted state. The elastic portions 8*c* are connected to the bend portions 8*d* at the upper sides thereof, and only the lower sides of the elastic portions 8*c* are displaced as mentioned above. Therefore, the elastic portions 8*c* as a whole are tilted with respect to the flat conductor 3 in the fitted state. The fastening portions 8*a* protrude from the elastic portions 8*c*. By tilting the elastic portions 8*c*, the fastening portions 8*a* are displaced away from the flat conductor 3. Therefore, the fastening portions 8*a* are removed from the fastening recessed portions 3*c*, and the contact edges 8*a*1 of the fastening portions 8*a* move away from the edge portions 3*c*1 of the fastening recessed portions 3*c*, so that the contact edges 8*a*1 of the fastening portions 8*a* are unfastened from the edge portions 3*c*1 of the fastening recessed portions 3*c*.

In this way, according to the embodiment, by pushing the push portion 8*f*2 downward in the height direction Z, the operation portion 8*f*, the stoppers 8*g*, and the elastic portions 8*c* rotate around the bend portions 8*d* as fulcra, so that it is possible to unfasten the fastening portions 8*a* from the flat conductor 3. Therefore, even if mounted components are closely disposed in the vicinity of the connector 1 that is mounted on the substrate 2, and it is difficult to displace the push portion 8*f*2 in the plate surface direction of the substrate 2, it is possible to unfasten the fastening portions 8*a* from the flat conductor 3.

When the operation portion 8*f* and the stoppers 8*g* are tilted such that the lower side of the operation portion 8*f* and the lower sides of the stoppers 8*g* approach the flat conductor 3 in the fitted state, the lower side of the operation portion 8*f* also approaches the front wall 4*h*. Therefore, a guide surface 4*j* as a "guide surface portion" that forms a space for displacing the operation portion 8*f* is formed at the lower side of the front wall 4*h* so as to prevent the front wall 4*h* from coming into contact with the operation portion 8*f* and hindering the displacement of the operation portion 8*f*. The guide surface 4*j* is provided such that a plate thickness of the front wall 4*h* is reduced towards the lower side, and allows the operation portion 8*f* to be sufficiently tilted by an amount that allows the fastening portions 8*a* to move out from the fastening recessed portions 3*c*.

As mentioned above, the push portion 8*f*2 is disposed between the thick-walled portions 4*i* and 4*i*. Since the front end of the push portion 8*f*2 protrudes beyond the front sides of the thick-walled portions 4*i* and 4*i*, an operator (not shown) is capable of easily touching the push portion 8*f*2, so that the operator is capable of easily pushing the push portion 8*f*2. If the top surface of the push portion 8*f*2 is provided at a side of the substrate 2 and at a side of a bottom wall 4*d*2, it becomes difficult for the operator to see the push portion 8*f*2 and also to touch the push portion 8*f*2. Therefore, it becomes difficult for the operator to push the push portion 8*f*2. In contrast, in the embodiment, the top surface of the push portion 8*f*2 is provided at a side opposite to the substrate 2 in the housing 4 and at a side of the top wall 4*d*1. Consequently, the operator (not shown) is capable of easily seeing and touching the push portion 8*f*2, so that the push portion 8*f*2 is easily pushable. Further, since the thick-walled portions 4*i* and 4*i* function as guides when the push portion 8*f*2 is displaced downward, it is possible to smoothly push the push portion 8*f*2 downward.

Outer peripheries of the extending portions 8*g*1 are covered by inside walls defining the through holes 4*i*2 in the thick-walled portions 4*i*, so that displacements in directions other than the height direction Z are restricted. The inside walls defining the through holes 4*i*2 function as guides when the contact sections 8*g*2 of the stoppers 8*g* are displaced along the height direction Z. This makes it possible for the contact sections 8*g*2 to be smoothly displaced along the height direction Z.

As described above, in the connector 1, the operation portion 8*f* and the fastening portions 8*a* are formed as one member and are integrated with each other. Therefore, during the unfastening, it is possible to reduce the number of components compared to a connector in which another member is used to push the fastening portions 8*a*, the fastening portions 8*a* are moved away from the fastening recessed portions 3*c* of the flat conductor 3, and the fastening portions 8*a* are unfastened.

Structure for Preventing Plastic Deformation of Operation Portion

When the push portion 8*f*2 is pushed, the push portion 8*f*2 is displaced downward in the height direction Z. Here, if the push portion 8*f*2 is strongly pulled towards the front, the operation portion 8*f* may be plastically deformed and may not return to its original position. Therefore, in the embodiment, the stoppers 8*g* that are connected to the operation portion 8*f* are provided. When the push portion 8*f*2 is displaced downward in the height direction Z, the contact sections 8*g*2 of the stoppers 8*g* are also displaced downward in the height direction Z, and come into contact with the opening edges 4*i*3 of the front wall 4*h*. This no longer allows the push portion 8*f*2 to be pushed further downward. Therefore, it is possible to reduce the frequency with which the operation portion 8*f* is excessively displaced. Consequently, it is possible to suppress the occurrence of such plastic deformation mentioned above.

However, even if the stoppers 8*g* are provided as mentioned above, the front wall 4*h* may be deformed or fractured as a result of not being able to withstand a force that is applied thereto due to pushing of the front wall 4*h* by the stoppers 8*g* when the stoppers 8*g* come into contact with the plate surface of the front wall 4*h* in a plate thickness direction of the wall.

When a force is applied to the front wall 4*h*, the greater the length of the front wall 4*h* in the direction in which the force is applied, the larger the rigidity with respect to this force. Therefore, if the length of the front wall 4*h* in the plate surface direction of the front wall 4*h* is greater than the length of the front wall 4*h* in the plate thickness direction of the front wall 4*h*, the frequency with which the front wall 4*h* is deformed and fractured is reduced when the same force is applied from a plate edge in the plate surface direction than in the plate thickness direction. Therefore, in the embodiment, the contact edge sections 8*g*3 that are provided at the contact sections 8*g*2 of the stoppers 8*g* are such as to strike the opening edges 4*i*3 of the thick-walled portions 4*i* at the front wall 4*h* in the insertion direction of the flat conductor 3. In the embodiment, the length of the front wall 4*h* in the plate surface direction, that is, the insertion direction of the flat conductor 3 is greater than the length of the front wall 4*h* in the plate thickness direction. Therefore, compared to when a force is applied from the plate surface of the front wall 4*h* in the plate thickness direction, it is possible to reduce the frequency with which the front wall 4*h* is deformed and fractured. Consequently, it is possible for the front wall 4*h* to reliably receive the stoppers 8*g* and to suppress the occurrence of plastic deformation of the operation portion 8*f*.

When the through holes 4*i*2 and the opening edges 4*i*3 are provided at the wall body 4*g* of the front wall 4*h*, the opening edges 4*i*3 become even thinner, as a result of which the rigidities of the opening edges 4*i*3 are reduced. In this case, the front wall 4*h* may become deformed and fractured because the front wall 4*h* is not capable of withstanding a force that is applied thereto when the contact edge sections 8*g*3 of the stoppers 8*g* come into contact with the front wall 4*h*. In contrast, in the embodiment, the thick-walled portions 4*i* are provided at the front wall 4*h*, and the through holes 4*i*2 in which the stoppers 8*g* are inserted and the opening edges 4*i*3 with which the contact edge sections 8*g*3 of the stoppers 8*g* contact are provided at the thick-walled portions 4*i*. Therefore, it is possible to prevent the opening edges 4*i*3 from becoming thin, and for the opening edges 4*i*3 to have high rigidity. As a result, it is possible for the opening edges 4*i*3 to be edges that are less likely to be deformed and fractured.

The extending portions 8*g*1 of the stoppers 8*g* extend in a cantilever manner from the operation portion 8*f*, and are capable of being elastically deformed independently of the flat plate portions 8*f*1. Therefore, it is possible to displace the operation portion 8*f* and the stopper portions 8*g* in different directions, such as displacing the stoppers 8*g* downward along the height direction Z even if the flat plate portion 8*f*1 is tilted by pushing the operation portion 8*f* downward while the operation portion 8*f* is pulled towards the front. Consequently, it is possible to reliably bring the contact edge sections 8*g*3 into contact with the opening edges 4*i*3 of the opening portions 4*i*2 by displacing the contact edge sections 8*g*3 along the height direction Z.

Structure for Preventing Improper Insertion

In the embodiment, a length L1 between the thick-walled portions 4*i* and 4*i* of the front wall 4*h* is less than a plate width L2 of the flat conductor 3. This makes it possible to prevent an operator from accidentally inserting the flat conductor 3 into a gap between the thick-walled portions 4*i* and 4*i* and a gap between the operation portion 8*f* and the front wall 4*h*.

As described above, according to the connector 1 of the embodiment, it is possible to easily unfasten the connector 1 from the flat conductor 3 even if other mounted components are closely placed on the substrate 2. Therefore, it is possible to mount the connector 1 close to the other mounted components on the substrate 2, so that it is possible to effectively use a narrow space above the substrate 2.

Modification

In the embodiment, the connector 1 is described as one including thick-walled portions 4*i* and 4*i* at the front wall 4*h*, each thick-walled portion 4*i* having a through hole 4*i*1 in which a stopper 8*g* is inserted and an opening edge 4*i*3 serving as a contact section. On the other hand, it is possible to accommodate the stoppers 8*g* in the interior of the fitting chamber 4*b*, expose the contact edge sections 8*g*3 from the insertion opening 4*a*, use plate edges of the top wall 4*d*1 as the contact sections, and bring the contact edge sections 8*g*3 of the stoppers 8*g* into contact with the contact sections. This makes it possible to reduce the amount of protrusion to the outside. Therefore, it is possible for the connector 1 to be compact as a whole.

In the embodiment, the connector 1 that is vertically placed on the substrate 2 and in which the flat conductor 3 is inserted in a direction orthogonal to the substrate 2 is described. However, the connector 1 may be one that is horizontally placed on the substrate 2 and in which the flat conductor 3 is inserted in a direction parallel to the substrate 2. By this, even if the operation portion 8*f* cannot be raised in a direction away from the substrate 2, that is, towards the upper side of the connector 1 due to space-related reasons, it is possible to unfasten the lock lever 8 from the flat conductor 3 by pushing the push portion 8*f*2 in the insertion direction of the flat conductor 3, that is, in a direction parallel to the plate surface of the substrate 2.

What is claimed is:

1. A connector comprising:

a terminal that electrically contacts a flat conductor serving as an object to be connected;

a housing including an insertion opening for inserting the flat conductor therein, a fitting chamber where the flat conductor and the terminal electrically contact each other, and a side wall portion that forms the fitting chamber; and a lock lever that is fastened to the flat conductor that is fitted to the terminal, and maintains electrical connection between the terminal and the flat conductor, wherein the lock lever includes a fastening portion that, in an interior of the fitting chamber, is fastened to the flat conductor that electrically contacts the terminal, and prevents removal of the flat conductor, an elastic portion that displaces the fastening portion in directions towards and away from the flat conductor, an operation portion that includes a flat plate portion and a connecting portion, the flat plate portion extending along the side wall portion, the connecting portion extending from the flat plate portion in the direction away from the flat conductor and connected to the elastic portion, wherein the flat plate portion is pushed along an insertion direction of the flat conductor, so that the connecting portion pushes the elastic portion in the direction away from the flat conductor and the fastening portion is displaced in the direction away from the flat conductor to unfasten the lock lever from the flat conductor, and a stopper that stops displacement of the operation portion by contacting the housing, and wherein the flat plate portion of the operation portion is connected to the stopper and the connecting portion.

2. The connector according to claim 1, wherein the stopper includes a base end portion that is connected to the flat plate portion and connecting portion, the stopper being displaced along with the operation portion and contacting the side wall portion to stop the displacement of the operation portion.

3. The connector according to claim 1, wherein the side wall portion includes a contact section that the stopper strikes in the insertion direction of the flat conductor.

4. The connector according to claim 1, wherein the stopper includes an extending portion that extends in a cantilever manner from the operation portion.

5. The connector according to claim 4, wherein the extending portion is elastically deformed independently of the operation portion.

6. The connector according to claim 1, wherein the stopper includes a plate edge portion that contacts the side wall portion.

7. The connector according to claim 1, wherein the side wall portion includes a thick-walled portion that protrudes in a plate thickness direction of the side wall portion and that the stopper contacts.

8. The connector according to claim 7, wherein the housing includes a plurality of the thick-walled portions, the operation portion is disposed between the thick-walled portions, and an interval between the thick-walled portions is less than a plate width of the flat conductor.

9. The connector according to claim 1, wherein the operation portion is pushed and displaced so as to approach the side wall portion, and the side wall portion includes a guide surface portion that guides the displacement of the operation portion.

10. The connector according to claim 1, wherein the operation portion includes a push portion that is connected to the flat plate portion and that is subjected to the pushing, and the push portion is provided at a top surface side of the housing.

11. The connector according to claim 1, wherein the lock lever includes a housing securing portion that is secured to the housing and a substrate securing portion that is exposed from an opposing side wall portion opposing the side wall portion and that is secured to a substrate.

12. The connector according to claim 1, wherein the side wall portion includes a leg that contacts a substrate and that supports the housing.

13. The connector according to claim 1, wherein the lock lever includes a plurality of the fastening portions that are unfastened by operating the operation portion.

* * * * *